US005981152A

United States Patent [19]

Komatsu

[11] Patent Number: 5,981,152

[45] Date of Patent: Nov. 9, 1999

[54] METHOD FOR PROCESSING BLACK-WHITE SILVER HALIDE PHOTOGRAPHIC LIGHT-SENSITIVE MATERIAL BY AN AUTOMATIC PROCESSOR

[75] Inventor: Hideki Komatsu, Hino, Japan

[73] Assignee: Konica Corporation, Japan

[21] Appl. No.: 09/210,252

[22] Filed: Dec. 11, 1998

[30] Foreign Application Priority Data

Dec. 16, 1997 [JP] Japan ..... 9-346488

[51] Int. Cl.[6] ..... G03C 5/29

[52] U.S. Cl. ..... 430/434; 430/398; 430/399; 430/400; 430/401

[58] Field of Search ..... 430/434, 401, 430/398, 399, 400

[56] References Cited

U.S. PATENT DOCUMENTS 5,334,492 8/1994 Wernicke et al. ..... 430/398

5,736,304 4/1998 Rider et al. ..... 430/398

*Primary Examiner*—Hoa Van Le

*Attorney, Agent, or Firm*—Jordan B. Bierman; Bierman, Muserlian and Lucas

[57] ABSTRACT

A method for processing a black-white silver halide photographic light-sensitive material by an automatic processor comprising the following steps, a step for preparing a processing solution by dissolving a solid processing composition or a condensed processing solution in a dissolving tank, a step for supplying said processing solution from said dissolving tank to a processing tank, a step for supplying part of said processing solution used for processing in said processing tank to said dissolving tank, wherein said black-white silver halide photographic light-sensitive material is processed with said processing solution in said processing tank and the flow of said processing solution from said processing tank to said dissolving tank is irreversible.

16 Claims, 3 Drawing Sheets

METHOD FOR PROCESSING BLACK-WHITE SILVER HALIDE PHOTOGRAPHIC LIGHT-SENSITIVE MATERIAL BY AN AUTOMATIC PROCESSOR

FIELD OF THE INVENTION

The present invention relates to a method for processing a black-white silver halide photographic light-sensitive material with more reduced amount of waste processing liquid.

BACKGROUND OF THE INVENTION

A silver halide photographic light-sensitive material (hereinafter referred to as a "light-sensitive material") employed in graphic arts is generally exposed and then processed employing an automatic processor comprising at least a development section, a fix section, a water wash section or stabilizing bath section and a drying section. Each processing solution in each processing tank of developer, fixer, washing water, stabilizer and so on is replenished depending on the amount of processed light-sensitive material, to compensate the consumed components and make up for the lowering of processing activity caused by the compounds which leach out of processed light-sensitive material and components which are brought in from the preceding processing tank. The amount of the processing solution exceeding the predetermined amount is overflowed as a waste solution.

In recent years, because of reducing environmental load, open sea disposal of photographic processing effluent has been prohibited, and lowering replenishment rate has been rapidly propelled in accordance with reduction of the load of effluent disposal. Therefore, more condensed solution kit of replenisher has been greatly demanded. On the other hand, to avoid the problem to use the condensed solution kit of replenisher, solid processing composition of a granule form or a tablet form has been also more popular.

FIG. 1 illustrates a model of a replenishment system using tablet form replenisher which is conventionally used to process black-white light-sensitive materials.

In FIG. 1, 1 represents a replenishment apparatus and 2 represents a processing tank of an automatic processor.

The adjustment of a replenisher is carried out by introducing the determined amount of water from water works into a dissolving tank 11 of the replenishment apparatus 1 and adding tablet form replenisher into a tablet inlet apparatus 12, thereafter the resultant mixture is mixed, stirred and dissolved. The replenisher adjusted in the dissolving tank 11 is introduced to a replenisher accumulating tank 13. Pump P begins to work by receiving a signal from the automatic processor which informs the processed area of light-sensitive material. The amount of replenisher in accordance with the processed area is calculated from the predetermined amount of replenisher per unit processed area (in this case, 10 ml/10×12 inch$^2$ size). The replenisher is supplied to a processing tank 2 from the replenisher accumulating tank 13 through a replenisher supplying line 14, thereby with the inflow of replenisher from the replenisher accumulating tank 13, the same amount of the outflow of processing solution (tank solution) is overflowed as a waste solution.

In the processing system of silver halide color photographic light-sensitive materials, where controlling the dissolution rate of a tablet form replenisher is relatively easy, direct dissolving method of the tablet form replenisher is mostly employed, wherein the solution circulates between the processing tank and the replenishing tank at all time and the tablet is directly added to the solution in the replenishing tank, whereby in proportion to processing, by the tablet form replenisher gradually being dissolved, processing components and other active additives are supplied, and the same amount of an outflow equivalent to the amount of replenishing water supplied into processing tank is overflowed as a waste solution. Compared with the processed area of color light-sensitive materials, that of black-and-white light-sensitive materials used in X-ray photographic field and graphic arts field are much more larger, to control dissolving rate of the tablet form replenisher by similar dissolving method mentioned above is impossible so that the method as shown in FIG. 1 is employed. The dissolution rate of replenishing tablet depends on the kind of additives contained in the replenishing tablet. As the film size increases, the amount of reprenishing solution in processing one time increases, accordingly, the processing is more affected by the dissolution rate, sequentially, the fluctuation of image density of the processed light-sensitive material increases. Accordingly, in case where the film size is large, the dissolution rate must be strictly controlled, and to control the foregoing dissolution rate is very difficult.

SUMMARY OF THE INVENTION

Accordingly, in the process for black-and-white light-sensitive materials, the same amount of waste solution equivalent to that of the replenisher solution which inflows into the processing tank is generated. However, concentrating the replenisher meets a limit because of the solubility of each component and reduction of the waste solution is extremely difficult.

An object of the invention is to provide more reduction of the waste solution in processing black-and-white light-sensitive materials.

DETAILED DESCRIPTION OF THE INVENTION

Figure 1:
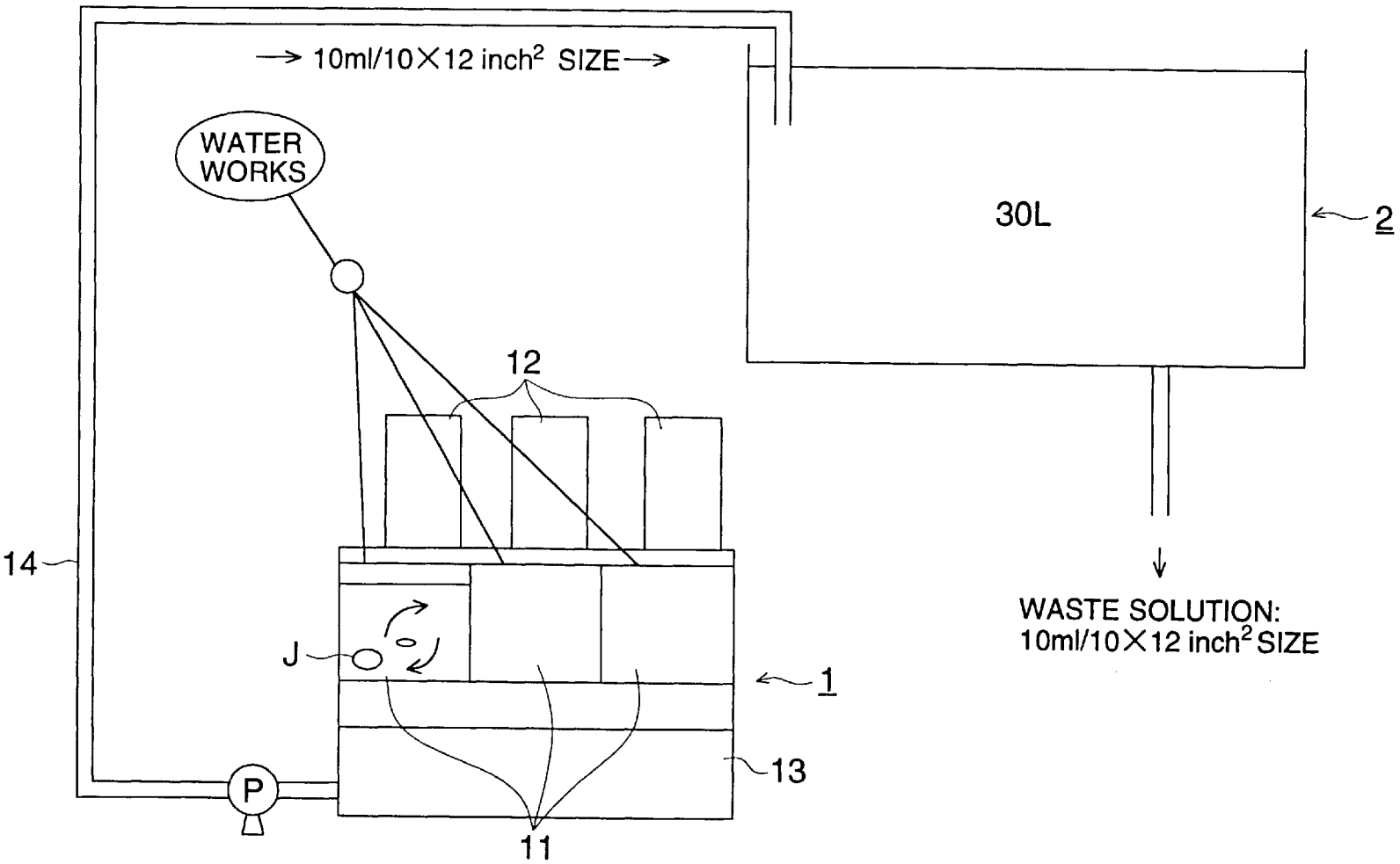
FIG. 1 illustrates the model of a replenishment system using tablet form replenisher which is conventionally used to process black-and-white ligth-sensitive materials.

Above object of the invention could be attained by the following method.

1. A method for processing a black-white silver halide photographic light-sensitive material by an automatic processor comprising the following steps, a step for preparing a processing solution by dissolving a solid processing composition or a condensed processing solution in a dissolving tank, a step for supplying said processing solution from said dissolving tank to a processing tank, a step for supplying part of said processing solution used for processing in said processing tank to said dissolving tank, wherein said black-white silver halide photographic light-sensitive material is processed with said processing solution in said processing tank and the flow of said processing solution from said processing tank to said dissolving tank is irreversible.

2. The method for processing the black-white silver halide photographic light-sensitive material by the automatic processor of item 1, wherein the processing solution supplied from said processing tank to said dissolving tank is part or all of an overflow outflowed from said processing tank.
3. The method for processing of item 1, wherein said dissolving tank possesses a dissolving portion to make the processing solution by dissolving said solid processing composition or said condensed processing solution, and a accumulating portion to accumulate said processing solution made in said dissolving portion, and said dissolving tank supplies the accumulated solution in said accumulating portion to said processing tank.
4. The method for processing of item 1, wherein the supply of said processing solution from said dissolving tank to said processing tank is carried out according to the amount of processed said black-white silver halide photographic light-sensitive material and/or operating time of said automatic processor.
5. The method for processing of item 1, wherein said dissolving tank is provided with means to discharge the solution out of said dissolving tank.
6. The method for processing of item 1, wherein the supply of water to said dissolving tank is carried out according to the amount of processed said black-white silver halide photographic light-sensitive material and/or operating time of said automatic processor.
7. The method for processing of item 1, wherein said processing solution is fixing solution and said dissolving tank or said processing tank is provided with means to recover silver.
8. The method for processing of item 1, wherein when said processing solution from said processing tank to said dissolving tank is not supplied, there exists an air gap in a flowing line from said processing solution to said dissolving tank.
9. The method for processing of item 1, wherein the concentration of the processing solution supplied from said dissolving tank to said processing tank is constant.
10. The method for processing of item 1, wherein said processing solution is prepared by dissolving all of a predetermined amount of said solid processing composition or said condensed processing solution in said dissolving tank, thereafter said prepared processing solution is supplied from said dissolving tank to said processing tank.
11. The method for processing of item 1, wherein dissolving time of 10 g of said solid processing composition or said condensed processing solution in 1 liter of water at the temprature of 25° C. is not more than 1 minute.
12. The method for processing of item 1, wherein said processing tank and said dissolving tank are each equipped in different apparatus and said processing tank is connected with said dissolving tank by pipe for flowing line.
13. The method for processing of item 1, wherein said dissolving tank possesses a capacity to accumulate the amount of water which is not less than 5 times in weight as heavy as that of said solid processing composition or said condensed processing solution dissolved one time.
14. The method for processing of claim 1, wherein said solid processing composition or said condensed processing solution is each for development and each contains auxiliary developer whose content is not more than 1% in an amount of the total weight of said solid processing composition or said condensed processing solution dissolved one time.
15. The method for processing of claim 1, wherein said solid processing composition or said condensed processing solution is each for the development and each contains restrainer whose content is not more than 1% in an amount of the total weight of said solid processing composition or said condensed processing solution dissolved one time.
16. The method for processing of claim 1, wherein said solid processing composition or said condensed processing solution is each for the development and each contains anti-silversludge agent whose content is not more than 1% in an amount of the total weight of said solid processing composition or said condensed processing solution dissolved one time.

Next, the terms used in this invention will be explained.

(Processing tank)

Processing tank in this invention means the tank which performs development, fixing, stabilization, washing, etc. There is no limitation with shape and quality of said tank as long as said tank works well. Generally, the processing tank means developing tank, fixing tank, washing tank and rinsing tank and so on.

(Dissolving tank)

Dissolving tank in the invention means the tank in which replenishing components are dissolved or dissolved for mixing in the processing way, in which the replenishing components are replenished in accordance with the amount of the processed light-sensitive material. There is no limitation with shape and quality of said tank as long as said tank works well. It is preferred that said dissolving tank possesses means to dissolve or mix the replenishing components. Said means is for accelerating the dissolution and there is no limitation with respect to the fashion. However, a rotational blade, circulating method and so on are usually useful in accelerating the dissolution. As to the form of replenishing agents, any form such as powder form, particle form, tablet form, blocked form, liquid form, paste form and so on can be employed, among them the particle form and tablet form are preferable.

There are two types of the dissolving tanks, one (Type 1) which supplies the processing solution from the dissolving tank to the processing tank after dissolving all of predetermined amount of the solid processing composition or the condensed processing solution one time, another one (Type 2) which supplies the processing solution from the dissolving tank to the processing tank in course of dissolving the solid processing composition or the condensed processing solution.

Type 1 is preferable because it can supply a constant concentration of the processing solution from the dissolving tank to the processing tank. Further, Type 1 is divided into two types, one which has the dissolving portion and the accumulating portion, another one which has only the dissolving portion to completely dissolve the solid processing composition or the condensed processing solution in the dissolving portion and then supply the processing solution.

Since the processing solution for the black-white light-sensitive material, especially the processing solution for the development contains extremely small quantity of components such as an auxiliary developer, a restrainer and an anti-silversludge agent etc., processing characteristics are easily influenced by little change of concentration of the processing solution. The content of the auxiliary developer, the restrainer and the anti-silversludge agent etc. is preferably not more than 1% in an amount of the total weight of the processing solution dissolved one time. Furthermore, because the dissolving time of the processing agents for black-white silver halide photographic material is shorter than that for silver halide color photographic material, for example, the dissolving time of 10 g of each processing agent in 1 liter of water at the temprature of 25° C. is not more than 1 minute, the concentration fluctuation tends to become large when the processing agents are dissolved. Accordingly, Type 2 which supplies the processing solution in course of dissolving the processing agents is not preferable because of large concentration fluctuation of the processing agents, but it is preferable to construct an apparatus at low cost. Therefore, in the case of using Type 2, to retrain the concentration fluctuation, the dissolving portion of the dissolving tank preferably possesses a capacity to accumulate the amount of water which is not less than 5 times in weight as heavy as that of said solid processing composition or said condensed processing solution dissolved one time. In other words, in the dissolving tank, the processing agents are dissolved in the solution having the same volume of water which is not less than 5 times in weight as heavy as the processing agents. The processing tank and the dissolving tank are constructed in different apparatus (for example, such as the automatic processor having the processing tank and the dissolving apparatus having the dissolving tank), and connected each other by the flowing line such as pipe. It is preferable that supplying form of the processing composition is easily reformed without reforming the automatic machine by only reforming the dissolving apparatus. And one set of the dissolving apparatus can be connected by the flowing lines with plural automatic processors.

(Pipe connecting the processing tank with the dissolving tank)

In the invention, a flow line in which the processing solution flows is constructed between the processing tank and the dissolving tank so that the processing solution can move between the processing tank and the dissolving tank. Said flow line connects the processing tank with the dissolving tank and said flow line preferably consists of pipe. There is no limitation with shape and quality of said pipe as long as the processing solution moves well. There are at least two pipes between each processing tank and each dissolving tank corresponding to each processing tank. At least one of them is for transferring the processing solution from the dissolving tank to the processing tank and is equipped with a transferring means such as a pump and so on. The transferring means such as a pump and so on preferably works by receiving a signal from the automatic processor and it is more preferable that the signal from the automatic processor is predetermined according to the processed amount such as the processed area of the light-sensitive material and/or operating time of the automatic processor. More concrete explanation is given below. It is preferable that the processing solution is supplied from the dissolving tank to the processing tank every predetermined and fixed processed amount and/or operating time of the automatic processor.

On the other hand, at least another one of them is for transferring the processing solution from the processing tank to the dissolving tank. The transfer of the processing solution from the processing tank to the dissolving tank is optionally done, and when the processing solution is supplied to the processing tank, part or all of the overflowed processing solution from the processing tank is also supplied to the dissolving tank. In that case, the pipe is preferably connected with a overflow outlet of the processing tank. In the flow line from the processing tank to the dissolving tank, the flow of the processing solution is irreversible and the reverse flow of the processing solution from the dissolving tank to the processing tank never takes place. When the overflowed processing solution is not transferred from the processing tank to the dissolving tank, there preferably exists a some portion in the pipe (the flow line), where there is no solution, in other words there preferably exists an air gap in the flow line. Furthermore, it is more preferable that there exits no solution at all in the pipe throughout. The transferring means preferably corresponds to a spontaneous falling caused by the overflow solution in accordance with the processing solution supply from the dissolving tank to the processing tank.

(Dissolving portion and accumulating portion)

The dissolving tank of the invention may be composed of dissolving portion for dissolving and accumulating portion for accumulating the processing solution until transferring the processing solution to the processing tank and there may be a tank for temporally accumulating the processing solution outflowed in front of the dissolving portion. There exists a transferring means for the processing solution between the dissolving portion and the accumulating portion. As for the transferring means, spontaneous falling and motive power such as a pump are available, but the transferring means is preferably able to prevent an adverse flow from the accumulating portion to the dissolving portion.

(Means to outflowing from the system)

In the present invention, the connecting pipe from the processing tank to the dissolving tank and/or the dissolving tank is preferably equipped with the means to discharge from the system. As the means to discharge from the system, any means such as a branch of the connecting pipe, an overflow and so on can be employed and the means to discharge from the system is preferably directly associated with a water supply and/or circulation in accordance with the processing. Fundamentally, it is preferred that the discharged amount from the system is equal to the amount of water supply in accordance with the processing, but the discharged amount from the system may be not more than the amount of water supply because of the amount of evaporation and the carryover by the light-sensitive material.

(Means to supply water)

In the present invention, the dissolving tank is preferably equipped with the means to supply water. The means to supply water preferably works by receiving the signal from the automatic processor in accordance with the processing. Said signal is preferably indicated by the amount of water supply calculated from the processed area of the light-sensitive material.

Furthermore, the means to supply water of the present invention preferably works by receiving the indication of the amount of water supply calculated from the operating time of the automatic processor from the viewpoint of preventing the concentration of the processing solution. As a means to prevent the concentration of the processing solution, the way to maintain solution surface constant by supplying water may be employed.

(Means to recover silver)

In the present invention, the processing tank and/or the dissolving tank relating to the fixing solution preferably possess means to recover silver. As to the means to recover silver, an electrolysis method and an adsorption method and so on are known well and there is no limitation to use the silver recovery method. Moreover, well known method can be used, for example such a method as described in Journal of the SMPTE, 74, pp.505–513 (June, 1965), can be used.

(Auxiliary developer)

An auxiliary developer according to the invention means a additve which exhibits supuradditive development when it is used in combination with the developers such as dihyroxybenzene derivatives or ascorbetic acid derivatives. Representative compounds are 3-pyrazolidone derivatives and p-aminopfenol derivatives. Examples of exemplified compounds are shown below, but not limited thereto.

1-phenyl-3-pyrazolidone 1-phenyl-4,4-dimethyl-3-pyrazolidone 1-phenyl-4-methyl-4-hydroxymethyl-3-pyrazolidone 1-phenyl-5-methyl-3-pyrazolidone 1-p-aminophenyl-4,4-dimethyl-3-pyrazolidone 1-p-tolyl-4,4-dimethyl-3-pyrazolidone 1-p-tolyl-4-methyl-4-hydroxymethyl-3-pyrazolidone N-methyl-p-aminophenol N-(β-hydroxyethyl)-p-aminophenol N-(β-hydroxyphenyl)glycine 2-methyl-p-aminophenol p-benzylaminophenol The preferable added amount of these compound is not less than. 1% of the total weight of the developer dissolved one time, more preferably 0.05 to 0.5%.

(Restrainer)

As a restrainer according to the invention is cited triazole derivative, tetrazole derivative, thiazole derivative and imidazole derivative etc., and preferable ones are 5-nitrobenzimidazole, 5-methylbenzotriazole and benzotriazole. The preferable added amount of these compound is not less than 1% of the total weight of the developer dissolved one time, more preferably 0.01 to 0.5%.

(Anti-silversludge agent)

As an anti-silversludge agent, the compound represented by the Formula (S) is preferably used Formula (S)

$$Z_1—SM_1$$

In Formula, $Z_1$ is an alkyl group, an aromatic group or a heterocyclic group, each of which has a substituent selected from the group consisting of a hydroxyl group, an $—SO_3M_2$ group, a $—COOM_2$ group (in which M represents a hydrogen atom, an alkali metal atom, or a substituted or unsubstituted ammonium ion), a substituted or unsubstituted amino group and a substituted or unsubstituted ammonio group, or a group having a group selected from the above group as the substituent thereof. $M_1$ represents a hydrogen atom, an alkali metal atom or a substituted or unsubstituted amidino group (which may be formed a salt with a hydrogen halide acid or sulfonic acid). In Formula (S), the alkyl group represented by $Z_1$ is preferably a straight- or branched-chain alkyl group having 1 to 30 carbon atoms, particularly 2 to 20 carbon atoms, and the alkyl group may have a substituent furthermore the above-mentioned substituent. The aromatic group represented by $Z_1$ is preferably a single ring or condensed ring aromatic group having 6 to 32 carbon atoms, and the aromatic group may have a substituent furthermore the above-mentioned substituent. The heterocyclic group represented by $Z_1$ is preferably a single ring or condensed ring heterocyclic group having 1 to 32 carbon atoms, namely a 5- or 6-member ring including a hetero-atom independently selected from nitrogen atom, oxygen atom and sulfur atom therein, and the heterocyclic group may have a substituent furthermore the above-mentioned substituent. When the heterocyclic group is a tetrazole ring, the tetrazole ring does not have a substituted or unsubstituted naphthyl group as the substituent. Among the compounds represented by Formula (S), a compound in which $Z_1$ is heterocyclic group having two or more nitrogen atoms, is preferred. The ammonio group is preferable an ammonio group having not more than 20 carbon atoms, and the substituent thereof is a substituted or unsubstituted straight-chain, branched-chain or cyclic alkyl group (such as methyl group, ethyl group, benzyl group, ethoxypropyl group or cyclohexyl group), substituted or unsubstituted phenyl group or a naphthyl group.

Next, the embodiment of the present invention will be explained based on illustrations, but the embodiment is not limited thereto.

Figure 2:
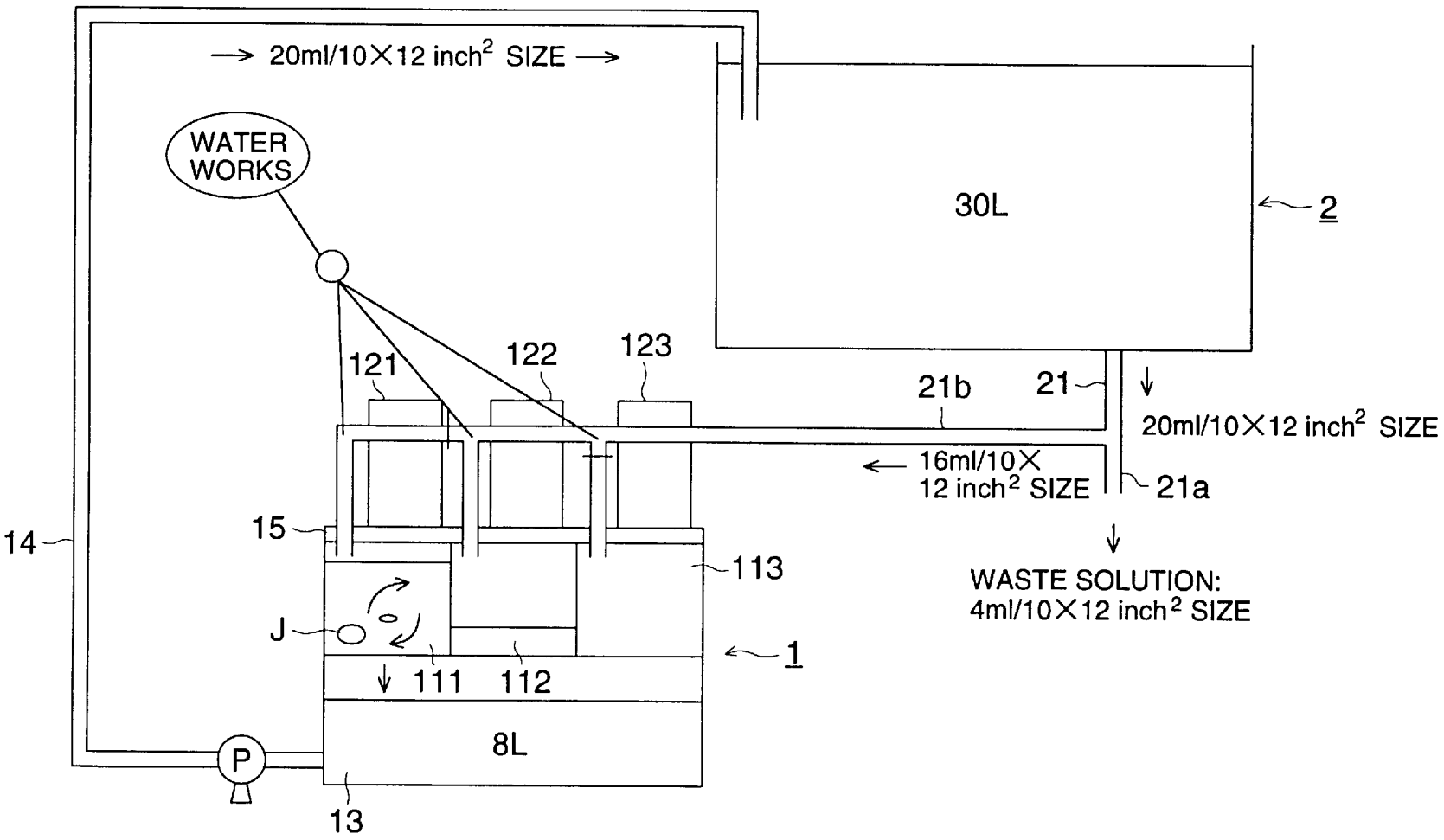
FIG. 2 illustrates the model of a replenishment system of this invention using tablet form replenisher which is used to process black-and-white ligth-sensitive materials.

In FIG. 2, a processing model of the embodiment of the present invention is illustrated. This is the model of Type 1 described above.

In FIG. 2, the replenishing apparatus 1 possesses three dissolving tanks (capacity of 1.0 liter) 111–113, and each dissolving tank is set with the tablet form replenisher kit 121–123. The replenishing solution was obtained by dissolving the tablet form replenisher in the dissolving tank, thus obtained solution was dropped in the under replenishing solution accumulating tank (capacity of 8.0 liter) 13 and used as the replenishing solution.

In the embodiment of the present invention, pump P begins to work by receiving a signal from automatic processor, and the replenishing solution which accords with the amount corresponding to the processed area of the light-sensitive material which is calculated from the predetermined circulating amount per unit area (in this case, 20 ml/10×12 $inch^2$ size), is supplied from the replenishing solution accumulating tank 13 through the replenishing solution supplying line 14 to the processing tank 2. And according to the inflow from the replenishing solution accumulating tank 13, the same amount of the processing solution (tank solution) is overflowed from the overflow pipe 21. Said 20 ml/10×12 $inch^2$ size overflowed solution is divided into two parts. One is 16 ml/10×12 $inch^2$ size overflowed solution which is returned to the dissolving tank through branched overflow pipe 21*b*. *Another one is* 4 ml/10×12 $inch^2$ size overflowed solution which is discharged as a waste solution through pipe 21*a*. There is no limitation to divide two parts, but by changing cross sectional area of each pipe, the ratio of the amount of the overflow solution reused to that of the discharged solution is controlled.

The overflow solution returned to the dissolving tank through pipe 21*b* passes through filter 15 consisting of silver adsorption polymer, active carbon and so on to mainly recover silver and adsorb compounds leaching out of the processed light-sensitive material. There are plural dissolving tanks, but the overflow solution flows into one tank until the predetermined amount of overflow is accumulated, after the accumulation of the overflow exceeds predetermined amount, an inlet cock is switched to another dissolving tank.

As to adjusting the replenishing solution, the tablet J of the replenisher is casted into the dissolving tank 111 from the tablet replenishing kit 121 and the amount of water corresponding to that of waste solution and evaporation is introduced to the dissolving tank 111 and the resultant mixture is stirred to be dissolved. The replenishing solution thus adjusted in the dissolving tank 111 is transferred to the under replenishing solution accumulating tank 13. The similar manner is repeated in the dissolving tank 112 and 113. In this invention, when the processed area of a sheet of film is not less than 0.07 $m^2$ or 10×12 $inch^2$, the effect of the invention is more remarkable.

Figure 3:
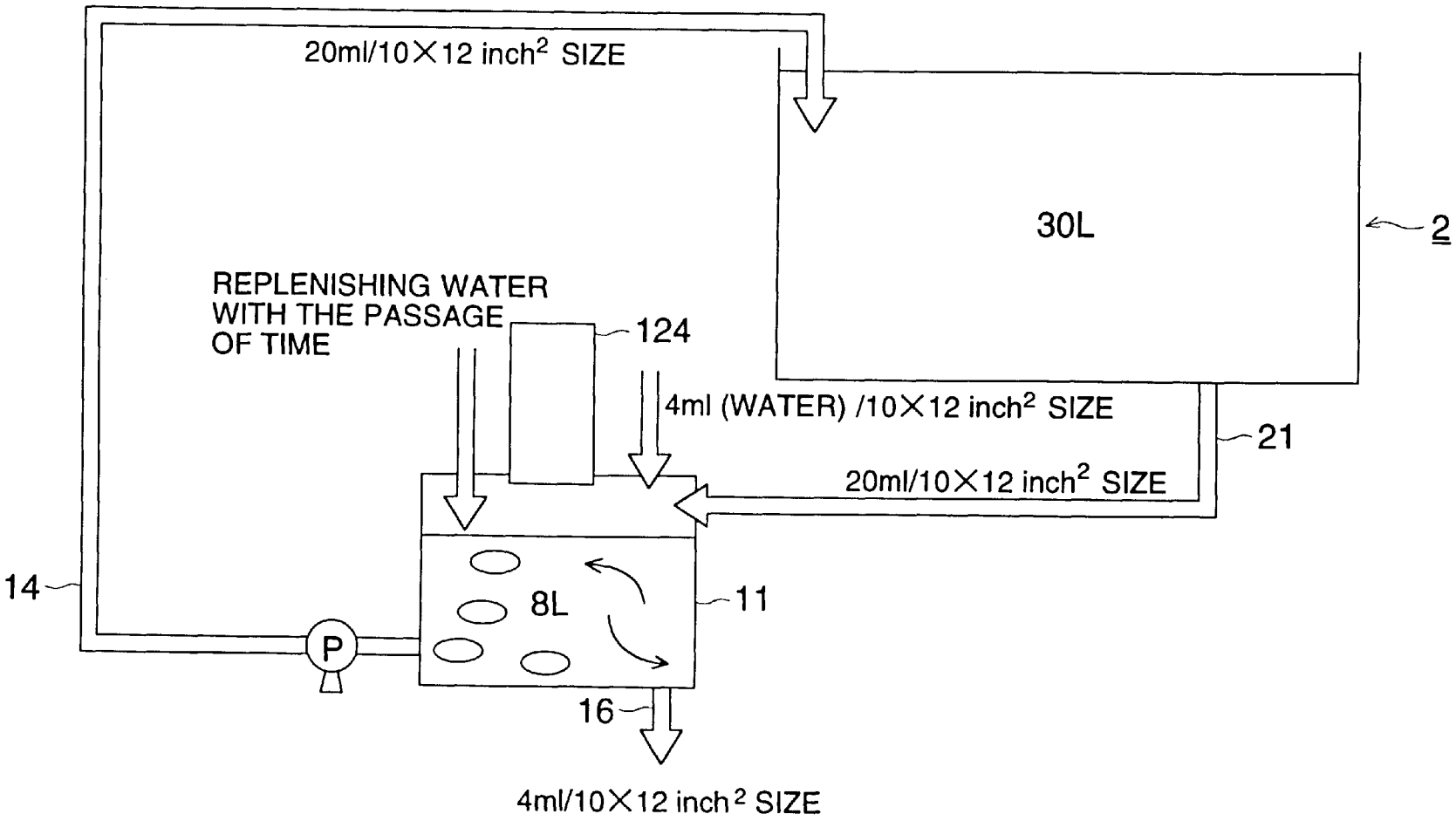
FIG. 3 illustrates the another model of a replenishment system of this invention.

In FIG. 3, another processing model of the embodiment of the present invention is illustrated. This is the model of Type 2 described above.

In the embodiment of the present invention, the processing solution circulates according to the processing in the processing system, and pump P begins to work by receiving a signal from automatic processor, and the amount of the replenishing solution which accords with the amount of processed area of the light-sensitive material (in this case, 20 ml/10×12 $inch^2$ size), is supplied from the dissolving tank 11 to the processing tank 2 through the replenishing solution supplying line 14. The same amount of the processing solution (tank solution) is overflowed from the overflow pipe 21 and the overflow solution is flowed in into the dissolving tank 11. And the dissolving solution in the dissolving tank 11 is replenished with the amount of water according to the processed area of the light-sensitive material (in this case, 4 ml/10×12 $inch^2$ size) by receiving a signal from the automatic processor.

In the embodiment of the present invention, the replenisher is adjusted by adding the replenisher components from the replenisher kit 124 to the dissolving tank 11 and the replenisher components are stirred and dissolved each time 200 sheets of the light-sensitive material with a size of 508×610 $mm^2$ are processed. The replenishing components need to be dissolved while 200 sheets of the light-sensitive material with a size of 508×610 $mm^2$ are being processed, and the replenisher is supplied from the dissolving tank 11 to the processing tank 2, notwithstanding the dissolving situation of the replenishing components. The overflow solution caused by replenishment of water mentioned above is outflowed through outflow pipe 16 as a waste solution. In order to prevent the concentration of the processing solution according to low replenishing amount, water required with the passage of time is replenished in accordance with the operating time of an automatic processor.

Furthermore it is preferred to circulate about 5 liter of the processing solution every two hours to reduce an influence caused by the processing interval.

The process-replenishment system according to the present invention can be advantageously employed in processing black-white silver halide photographic light-sensitive materials having large processed area which are used in graphic arts field and medical X-ray photographic field.

EXAMPLES

The examples of the invention will be explained below, but the invention is not limited thereto.

Example 1

[Producing a solid developer kit (necessary to process 200 sheets of the light-sensitive material with a size of 508×610 $mm^2$)]

(Pretreatment of raw materials)

Hydroquinone was pulverized by a pulverizer, MIKRO-PULVERIZER AP-B produced by Hosokawa Micron Co., Ltd. with a mesh of 8 mm and rotational rate of 25 Hz and 8-mercaptoadenine was similarly pulverized with the mesh of 8 mm and the rotational rate of 50 Hz.

(Mixing raw materials)

The following composition was mixed for 10 minutes in a commercially available V-type mixing vessel (capacity of 200 liter).

| | |
|---|---|
| Hydroquinone (pulverized mentioned above) | 68 kg |
| Elbit N (produced by Fujisawa Pharmaceutical Co., Ltd.) | 12 kg |
| Demezone S | 2.6 kg |
| (1-Phenyl-4-hydroxymethyl-4-methyl-3-pyrazolidone) | 1.2 kg |
| 8-Mercaptoadenine (pulverized mentioned above) | |
| Diethylenetriaminepentaacetic acid (DTPA.5H) | 11 kg |
| Sorbitol | 5 kg |

It was found that each compound in the above composition. had the concentration whose fluctuation was within ±5% of the above prescription by sampling arbitrarily each 50 g from 5 points of the above composition and analyzing each sample, therefore it is found that the above composition is mixed uniformly.

(Molding)

Thus obtained mixture was molded by compression granulator, briquetter BSS-IV produced by Shintokogyo Co., Ltd. with pocket form of 5.0 mmϕ×1.2 mm (depth), roller rotational rate of 20 rpm and feeder rotational rate of 50 rpm. The obtained tabular form molded object was crushed by a classifier and divided into granule having particle diameter of 2.4 mm to 7.0 mm and fine powder having particle diameter of not more than 2.4 mm. The granule having particle diameter of not less than 7.0 mm was crushed again and the fine powder having particle diameter of not more than 2.4 mm was mixed with the above mentioned mixture and returned to the compression granulator to be molded.

About 95 kg of the granule (referred as to DA) was obtained.

The following raw materials were prepared and pretreated.

(Mixing sodium sulfite/1-phenyl-5-mercaptotetrazole/benzotriazole)

In 400 ml of ethyl alcohol, 21 g of l-phenyl-5-mercaptotetrazole and 60 g of benzotriazole were dissolved. The obtained solution was poured little by little to 20 kg of sodium sulfite rotating in a mixer vessel and rotation was continued until the mixture was sufficiently dried up. By sampling arbitrarily each 10 g from 5 points of the obtained mixture and analyzing, it was found that 1-phenyl-5-mercaptotetrazole and benzotriazole were sufficiently mixed uniformly. The obtained mixture is termed M-1.

(Mixing potassium carbonate/sodium carbonate-anhydride/lithium hydroxide·$1H_2O$)

83 kg of potassium carbonate, 21 kg of sodium carbonate-anhydride and 40 kg of lithium hydroxide·$1H_2O$ were mixed for 10 minutes in a commercially available V-type mixing vessel (capacity of 200 1). The obtained mixture is termed M-2.

(Packing)

The mixtures of raw materials and molding product were filled up in the following order in standing pouch form and sealed up by a heat sealer.

| | | |
|---|---|---|
| Mixture M-1 | 230 g | (undermost layer) |
| Mixture M-2 | 310 g | (intermediate layer) |
| Granule DA | 160 g | (uppermost layer) |

The dissolution time of 10 g of above mentioned solid development composition kit was 48 sec. in 1 liter of water of the temperature of 25° C.

[Producing a solid fixer kit (necessary to process 200 sheets of the light-sensitive material with a size of 508×610 $mm^2$)]

(Pretreatment of a raw material)

Sodium 1-octanesulfonate was pulverized by the above mentioned pulverizer with the mesh of 4 mm and rotational rate of 60 Hz.

(Mixing raw materials)

The following composition was mixed for 10 minutes in the above mentioned V-type mixing vessel.

| | |
|---|---|
| Ammonium thiosulfate (including 10% sodium salt) | 108 kg |
| Sodium sulfite | 1 kg |
| Sodium metabisulfite | 9 kg |

1 kg of sodium 1-octanesulfonate (pulverized mentioned above) was added to the above obtained mixture and thus obtained mixture was mixed still more for 5 minutes.

(Molding)

Thus obtained mixture was molded by the compression granulator mentioned above with pocket form of 5.0 mmϕ× 1.2 mm (depth), roller rotational rate of 30 rpm and feeder rotational rate of 67 rpm. The obtained tabular form molded object was crushed by a classifier and divided into granule having particle diameter of 2.4 mm to 7.0 mm and fine powder having particle diameter of not more than 2.4 mm. The granule having particle diameter of not less than 7.0 mm was crushed again and the fine powder having particle diameter of not more than 2.4 mm was mixed with the above mentioned mixture and returned to the compression granulator to be molded.

About 95 kg of the granule (referred as to FA) was obtained.

(Mixing raw materials)

Additionally, the following composition was mixed for 10 minutes in the above mentioned V-type mixing vessel.

| | |
|---|---|
| Sodium acetate.anhydride | 45 kg |
| Dehydrated aluminum sulfate | 19 kg |
| Boric acid | 10 kg |
| Tartaric acid | 5 kg |
| Succinic acid | 42 kg |

(Molding)

Thus obtained mixture was molded by the compression granulator mentioned above with pocket form of 5.0 mmϕ× 1.2 mm (depth), roller rotational rate of 30 rpm and feeder rotational rate of 67 rpm. The obtained tabular form molded object was crushed by a classifier and divided into granule having particle diameter of 2.4 mm to 7.0 mm and fine powder having particle diameter of not more than 2.4 mm. The granule having particle diameter of not less than 7.0 mm was crushed again and the fine powder having particle diameter of not more than 2.4 mm was mixed with the above mentioned mixture and returned to the compression granulator to be molded.

About 115 kg of the granule (referred as to FB) was obtained.

(Packing)

The molded products were filled up in the following order in standing pouch form.

| | | |
|---|---|---|
| Granule FB | 240 g | (under layer) |
| Granule FA | 602 g | (upper layer) |

The dissolution time of 10 g of above mentioned solid fixing composition kit was 37 sec. in 1 liter of water of the temperature of 25° C.

[Process]

The processing system illustrated in FIG. 3 was constructed modifying an automatic processor GR-960 produced by Konica Co., Ltd.

The replenishing apparatus which could perform the same function of the system as illustrated in FIG. 3 was constructed and used. According to the replenisher-adding mechanism of the invention, each 4 kits produced above could be charged, and automatic unsealing and continuous charging could be done by receiving the signal indicating the process of 200 sheets of the light-sensitive material with a size of 508×610 $mm^2$ from the automatic processor.

The dissolving tank of the fixer was equipped with a silver recovery apparatus which could recover about half of the amount of silver leaching out of the light-sensitive material processed.

As a light-sensitive material, using AH-3 produced by Konica Co., Ltd., and as a developing starter and a fixing starter, using CDM-681 and CFL-881 respectively, processing 200 sheets of the light-sensitive material with a size of 508×610 $mm^2$ per a day was done for three months under the following condition. In this test, 20% of total area in the light-sensitive material was exposed and developed by this process.

(Processing condition)

| | Developing | Fixing | Washing | Drying |
|---|---|---|---|---|
| Temperature (° C.) | 35 | 35 | ordinary temp. | 50 |
| Processing time (sec.) | 30 | 20 | 20 | 20 |
| Circulating amount by process (ml/508 × 610 $mm^2$) | 80 | 80 | — | — |
| Circulating amount with the passage of time (ml/hr) | 500 | 500 | — | — |
| Amount of replenishing water by process (ml/508 × 610 $mm^2$) | 16 | 16 | — | — |
| Amount of Replenishing water with the passage of time (ml/hr) | 60 | 60 | — | — |
| Replenisher adding timing (sheets of 508 × 610 $mm^2$/kit) | 200 | 200 | — | — |

[Result]

The photographic characteristics showed excellent during processing.

Since no stain in automatic processor and no stain adhesion to the light-sensitive material were observed, an excellent result was obtained. Furthermore, the reduced amount of the waste solution by this method was 80% compared with conventional method.

Example 2

[Preparing solid processing composition]

Producing replenishing developer tablet (Producing developer part A (for 1 liter of a working solution))

| | |
|---|---|
| DTPA.5H | 11 kg |
| Sodium carbonate | 78.7 kg |
| Potassium carbonate | 20 kg |
| Sodium sulfite | 160 kg |
| Lithium hydroxide.$H_2O$ | 38 kg |

-continued

| | |
|---|---|
| D-mannitol | 28 kg |
| D-sorbitol | 12 kg |

The above composition was mixed in a bandom mill produced by Hosokawa Micron Co., Ltd. for 30 minutes, then the mixture was granulated by a commercially available stirring granulator at room temperature for 10 minutes, thereafter using a batch type freeze drier, the granulated mixture was cooled after the internal pressure was reduced to 5 mm Hg. The granulated mixture was treated at 20° C. for 12 hours and dried until a water content reached 1%. Thus the granule part A was obtained.

(Producing developer part B (for 1 liter of a working solution))

| | |
|---|---|
| 8-Mercaptoadenine | 1.2 kg |
| Dimezone S | 2.6 kg |
| Benzotriazole | 0.55 kg |
| Sodium sulfite | 23 kg |
| Sodium erysorbic acid | 12 kg |
| Hydroquinone | 68 kg |
| D-sorbitol | 13.9 kg |

From the composition mentioned above the granule part B was obtained in the same way in which the granule part A was obtained.

(Producing tablet)

Each of the above prepared granule part A and B was mixed for 10 min. at room temperature using a commercially available cross rotary type mixer, then to each of granular developer part A and part B was added sodium 1-octanesulfonate of 5.2 kg and 1.8 kg respectively, then each mixture was mixed for 3 min. Thus obtained mixed granule was continuously tabletted using a rotary tabletting machine (produced by Kikusui Seisakusho Co., Ltd., Clean Press Collect H18) and 17200 pieces of the developing replenisher tablet A with weight of 20.2 g per piece and 5900 pieces of the developing replenisher tablet B with weight of 20.4 g per piece were obtained. The dissolution time of 10 g of above mentioned solid development composition of part A was 31 sec. in 1 liter of water of the temperature of 25° C., and that of 10 g of above mentioned solid development composition of part B was 31 sec. in 1 liter of water of the temperature of 25° C.

(Packing)

One kit of the developing replenisher tablet was provided by packing 29 pieces of the developing replenisher tablet A together with 10 pieces of the developing replenisher tablet B in the standing pouch type packing material.

Producing replenishing fixer tablet (Producing fixer tablet part A)

| | |
|---|---|
| Ammonium thiosulfate (including 10% sodium salt, produced by Hoechst Co., Ltd.) | 108 kg |
| Sodium metabisulfite | 9 kg |
| Sodium sulfite | 1 kg |
| Sodium acetate | 11.25 kg |
| Pineflow (Produced by Matsugaya Kagaku) | 6.7 kg |

Materials described above were mixed in a bandom mill mentioned above for 30 min., the mixture was granulated at room temperature for 10 min., thereafter using a batch type freeze drier, the granulated mixture was cooled after the internal pressure was reduced to 5 mm Hg. The granulated mixture was treated at 20° C. for 12 hours and dried until a water content reached 1%. Thus the granule part A was obtained.

2 kg of sodium 1-octanesulfonate (a lubricant agent) was added to the part A mentioned above and the mixture was completely mixed for 10 min. After mixing, the mixture was subjected to compression-tabletting at 1.5 ton/$m^2$, using a tabletting machine, Machina UD DFE30 40 (available from Machina Corp.), to obtain 6650 pieces of tablet having a weight of 20.3 g per piece.

(Producing fixer tablet part B)

| | |
|---|---|
| Boric acid | 4 kg |
| Tartaric acid | 2 kg |
| Succinic acid | 16.3 kg |
| Sodium acetate | 6.25 kg |
| Aluminum sulfate.$8H_2O$ | 7 kg |
| D-mannitol | 1.8 kg |
| D-sorbitol | 0.8 kg |
| Polyethylene glycol (produced by Nihon Yuka Co., Ltd.: PEG#4000) | 0.5 kg |

From the composition mentioned above the granule part B was obtained in the same way in which the granule part A was obtained.

0.58 kg of sodium 1-octanesulfonate (a lubricant agent) was added to the part B mentioned above and the mixture was completely mixed for 10 min. After mixing, the mixture was subjected to compression-tabletting at 1.5 ton/$m^2$, using a tabletting machine mentioned above, to obtain 1800 pieces of tablet having a weight of 20.7 g per piece. The dissolution time of 10 g of above mentioned solid fix composition of part A was 28 sec. in 1 liter of water of the temperature of 25° C., and that of 10 g of above mentioned solid fix composition of part B was 49 sec. in 1 liter of water of the temperature of 25° C.

(Packing)

One kit of the fixing replenisher tablet was provided by packing 36 pieces of the fixing replenisher tablet A together with 10 pieces of the fixing replenisher tablet B in the standing pouch type packing material.

Except for using the above obtained solid replenisher, the evaluation was carried out in the same way in which example 1 was evaluated, and an excellent result was obtained as well as example 1. Furthermore, the reduced amount of the waste solution by this method was 80% compared with conventional method.

Example 3

Except for using FIG. 2 (not FIG. 3) as a system, the experiment was carried out in the same way in which example 1 was carried out. The replenishing apparatus which could perform the same function of the system as illustrated in FIG. 2 was constructed and used. According to the replenisher-adding mechanism of the invention, each 4 kits produced above could be charged, and automatic unsealing and continuous charging could be done by receiving the signal indicating the process of 200 sheets of the light-sensitive material with a size of 508×610 $mm^2$ from the automatic processor. The evaluation was carried out in the same way in which example 1 was evaluated, and an excellent result was obtained as well as; example 1. Furthermore, the reduced amount of the waste solution by this method was 80% compared with conventional method.

Example 4

Except for using FIG. 2 (not FIG. 3) as a system, the experiment was carried out in the same way in which example 2 was carried out. The evaluation was carried out in the same way in which example 1 was evaluated, and an excellent result was obtained as well as example 1. Furthermore, the reduced amount of the waste solution by this method was 80% compared with conventional method.

What is claimed is:

1. A method for processing a black-white silver halide photographic light-sensitive material by an automatic processor comprising the following steps, a step for preparing a processing solution by dissolving a solid processing composition or a condensed processing solution in a dissolving tank, a step for supplying said processing solution from said dissolving tank to a processing tank, a step for supplying part of said processing solution used for processing in said processing tank to said dissolving tank, wherein said black-white silver halide photographic light-sensitive material is processed with said processing solution in said processing tank and the flow of said processing solution from said processing tank to said dissolving tank is irreversible.

2. The method for processing the black-white silver halide photographic light-sensitive material by the automatic processor of claim 1, wherein the processing solution supplied from said processing tank to said dissolving tank is part or all of an overflow outflowed from said processing tank.

3. The method for processing of claim 1, wherein said dissolving tank possesses a dissolving portion to make the processing solution by dissolving said solid processing composition or said condensed processing solution, and a accumulating portion to accumulate said processing solution made in said dissolving portion, and said dissolving tank supplies the accumulated solution in said accumulating portion to said processing tank.

4. The method for processing of claim 1, wherein the supply of said processing solution from said dissolving tank to said processing tank is carried out according to the amount of processed said black-white silver halide photographic light-sensitive material and/or operating time of said automatic processor.

5. The method for processing of claim 1, wherein said dissolving tank is provided with means to discharge the solution out of said dissolving tank.

6. The method for processing of claim 1, wherein the supply of water to said dissolving tank is carried out according to the amount of processed said black-white silver halide photographic light-sensitive material and/or operating time of said automatic processor.

7. The method for processing of claim 1, wherein said processing solution is fixing solution and said dissolving tank or said processing tank is provided with means to recover silver.

8. The method for processing of claim 1, wherein when said processing solution from said processing tank to said dissolving tank is not supplied, there exists an air gap in a flowing line from said processing solution to said dissolving tank.

9. The method for processing of claim 1, wherein the concentration of the processing solution supplied from said dissolving tank to sa id processing tank is constant.

10. The method for processing of claim 1, wherein said processing solution is prepared by dissolving all of a predetermined amount of said solid processing composition or said condense d processing solution in said dissolving tank, thereafter said prepared processing solution is supplied from said dissolving tank to said processing tank.

11. The method for processing of claim 1, wherein dissolving time of 10 g of said solid processing composition or said condensed processing solution in 1 liter of water at the temprature of 25° C. is not more than 1 minute.

12. The method for processing of claim 1, wherein said processing tank and said dissolving tank is each divided and said processing tank is connected with said dissolving tank by at least a pipe for flowing line.

13. The method for processing of claim 1, wherein said dissolving tank possesses a capacity to accumulate the amount of water which is not less than 5 times in weight as heavy as that of said solid processing composition or said condensed processing solution dissolved one time.

14. The method for processing of claim 1, wherein said solid processing composition or said condensed processing solution is each for development and each contains auxiliary developer whose content is not more than 1% in an amount of the total weight of said solid processing composition or said condensed processing solution dissolved one time.

15. The method for processing of claim 1, wherein said solid processing composition or said condensed processing solution is each for the development and each contains restrainer whose content is not more than 1% in an amount of the total weight of said solid processing composition or said condensed processing solution dissolved one time.

16. The method for processing of claim 1, wherein said solid processing composition or said condensed processing solution is each for the development and each contains anti-silversludge agent whose content is not more than 1% in an amount of the total weight of said solid processing composition or said condensed processing solution dissolved one time.

* * * * *